US008986605B2

(12) United States Patent
Bowe et al.

(10) Patent No.: US 8,986,605 B2
(45) Date of Patent: Mar. 24, 2015

(54) METHOD AND ATMOSPHERE FOR EXTENDING BELT LIFE IN SINTERING FURNACE

(75) Inventors: Donald James Bowe, Zionsville, PA (US); Anna K. Wehr-Aukland, Macungie, PA (US); John Lewis Green, Palmerton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 909 days.

(21) Appl. No.: 12/966,440

(22) Filed: Dec. 13, 2010

(65) Prior Publication Data

US 2011/0318216 A1 Dec. 29, 2011

Related U.S. Application Data

(60) Provisional application No. 61/288,505, filed on Dec. 21, 2009.

(51) Int. Cl.

| | |
|---|---|
| ***C22C 33/02*** | (2006.01) |
| ***B22F 3/10*** | (2006.01) |
| ***C21D 1/76*** | (2006.01) |
| ***F27D 7/06*** | (2006.01) |
| *F27B 21/06* | (2006.01) |

(52) U.S. Cl.

CPC ..... *B22F 3/1007* (2013.01); *B22F 3/1017* (2013.01); *F27D 7/06* (2013.01); *F27B 21/06* (2013.01); *B22F 2999/00* (2013.01)

USPC ..... 419/59; 75/758; 148/216; 148/625; 148/708; 266/252

(58) Field of Classification Search

USPC ..... 75/755; 148/206–238, 559, 625–644, 148/708–714; 266/249–260; 419/56–60

See application file for complete search history.

(56) References Cited

U.S. PATENT DOCUMENTS 3,366,479 A * 1/1968 Storchheim et al. ..... 419/36

(Continued)

OTHER PUBLICATIONS

C.L. Rose, et al, Advances in Powder Metallurgy & Particulate Materials, Proceedings of International Conference on Powder Metallurgy & Particulate Materials, 1999, 3-17-3-28.

D. Garg, et al, Sintering of Carbon Steel Components in Endothermic and Nitrogen-Hydrogen Atmospheres, The Journal of Thermal Technology, 1999.

G. Ducharme, Measuring Dewpoint in Furnance Atmospheres, Vaisala News, 1999, 21-23.

(Continued)

*Primary Examiner* — Scott Kastler
*Assistant Examiner* — Vanessa Luk
(74) *Attorney, Agent, or Firm* — Rosaleen P. Morris-Oskanian; Amy Carr-Trexler

(57) ABSTRACT

Disclosed herein is a method and gas atmosphere for a metal component in a continuous furnace. In one embodiment, the method and gas atmosphere comprises the use of an effective amount, or about 1 to about 10 percent volume of endo-gas, into an atmosphere comprising nitrogen and hydrogen. In another embodiment, there is provided a method sintering metal components in a furnace at a one or more operating temperatures comprising: providing a furnace comprising a belt comprising a wire mesh material wherein the metal components are supported thereupon; and sintering the components in the furnace in an atmosphere comprising nitrogen, hydrogen, and effective amount of endothermic gas at the one or more operating temperatures ranging from about 1800° F. to about 2200° F. wherein the amount of endothermic gas in the atmosphere is such that it is oxidizing to the wire mesh material and reducing to the metal components.

3 Claims, 1 Drawing Sheet

(56) References Cited

U.S. PATENT DOCUMENTS

| | | | | |
|---|---|---|---|---|
| 4,106,931 | A * | 8/1978 | Nayar | 419/11 |
| 4,139,375 | A * | 2/1979 | Solomon et al. | 419/58 |
| 5,613,185 | A | 3/1997 | Marsden et al. | |

OTHER PUBLICATIONS

Seco/Warwick ad for Endogas Atmosphere Generators for Surface Protection in Hardening, Brazing, Sintering and Gas Carburizing (date unknown).

* cited by examiner

METHOD AND ATMOSPHERE FOR EXTENDING BELT LIFE IN SINTERING FURNACE

CROSS REFERENCE TO RELATED APPLICATION

This Application claims the priority benefit under 35 USC §119 of U.S. Provisional Application No. 61/288,505, filed on Dec. 21, 2009. The disclosure of the Provisional Application is hereby incorporated by reference in its entirety.

BACKGROUND OF THE INVENTION

Described herein are methods for sintering metal components, particularly steel components, using a controlled atmosphere. More particularly, described herein are methods for sintering steel components using an atmosphere comprising nitrogen and hydrogen and a method for pre-conditioning a metal belt prior to its operation in a sintering furnace.

Powder metallurgy is routinely used to produce a variety of simple- and complex-geometry carbon steel components requiring close dimensional tolerances, good strength and wear resistant properties. The technique involves pressing metal powders that have been premixed with organic lubricants into useful shapes and then sintering them at high temperatures in continuous furnaces into finished products in the presence of controlled atmospheres.

The overall cost of producing components by powder metallurgy has been known to be greatly affected by both the time and money spent on maintaining furnaces and by the cost of controlled atmospheres. The productivity and quality of components, on the other hand, are affected by furnace downtime and consistent composition of controlled atmospheres, respectively. Therefore, there is a need to develop methods and/or atmospheres that will assist in reducing downtime and maintenance costs and improving quality and productivity of components produced by powder metallurgy.

The continuous sintering furnaces normally contain three distinct zones, i.e., a preheating zone, a high heating zone, and a cooling zone. The preheating zone is used to preheat components to a predetermined temperature and to thermally assist in removing organic lubricants from components. The high heating zone is used to sinter components, and the cooling zone is used to cool components prior to discharging them from continuous furnaces.

The high heating zones of continuous furnaces used for sintering steel components are generally operated at temperatures above about 1,832° F. (about 1,000° C.). Because of high temperature operation, expensive, high temperature nickel-chromium containing alloys such as Inconel are used for building high heating zones of continuous furnaces. The use of these expensive, high temperature alloys helps in prolonging life of continuous furnaces and concomitantly reducing maintenance costs. Alternatively, relatively inexpensive stainless steels can also be used to build sintering furnaces. However, the later stainless steels have a shorter operative life than the high temperature nickel-chromium alloys.

The continuous mesh belts used to load and unload components in continuous furnaces are generally made of either expensive, high temperature nickel-chromium containing alloys such as Inconel or relatively inexpensive stainless steels. The expensive, high temperature nickel-chromium containing alloys are preferred materials for building wire mesh belts and obtaining longer life, but they are cost prohibitive and seldom used by the Powder Metal Industry. Stainless steel wire mesh belts are usually selected for sintering of steel components because of their high temperature properties and lower cost than the expensive alternatives, such as high temperature nickel-chromium containing alloys. Although stainless steel mesh belts require frequent maintenance, they are commonly used by the Powder Metal Industry because they are relatively inexpensive.

The controlled atmospheres used for sintering steel components are generally produced and supplied by endothermic generators, ammonia dissociators, or blending pure nitrogen with hydrogen. The endothermic ("endo-gas") atmospheres are produced by catalytically combusting controlled amount of a hydrocarbon gas, such as natural gas in air in endothermic generators. The endothermic atmospheres typically contain nitrogen (about 40%), hydrogen (about 40%), carbon monoxide (about 20%), and low levels of impurities, such as carbon dioxide, oxygen, methane, and moisture. The atmospheres produced by dissociating ammonia contain hydrogen (about 75%), nitrogen (about 25%), and impurities in the form of undissociated ammonia, oxygen, and moisture.

Nitrogen-hydrogen atmospheres produced by blending pure nitrogen with hydrogen have been used by the Powder Metal Industry for more than 30 years as alternatives to endothermically generated and dissociated ammonia atmospheres. Because these atmospheres are produced by blending pure nitrogen and hydrogen, they avoid problems associated with the exposure of workers to environmentally unfriendly and harmful gases. Furthermore, since the composition and flow rates of these atmospheres can be easily changed and precisely controlled, they have been widely accepted by the Powder Metal Industry for sintering steel components that require good carbon control, consistent quality and properties. U.S. Pat. No. 5,613,185, for example, disclosed nitrogen-hydrogen based atmospheres that include the use of a controlled amount of an oxidizing agent such as moisture, carbon dioxide, nitrous oxide, or mixtures thereof along with nitrogen-hydrogen containing atmospheres.

The nitrogen-hydrogen atmospheres are reducing to the sintered steel and to the stainless steel of the belt. Although pure nitrogen-hydrogen atmospheres containing less than 5 parts per million (ppm) oxygen and −80° F. (−62° C.) dew point (less than 10 parts per million (ppm) moisture) have been very useful in producing steel components with good quality, consistency, and properties, they have been found to impact negatively on the life of wire mesh belts made of both expensive, nickel-chromium containing alloys and relatively inexpensive stainless steels, thereby increasing downtime and maintenance costs. Therefore, there is a need to develop improved nitrogen-hydrogen based atmospheres for producing steel components by powder metallurgy with consistent quality and properties while improving life of wire mesh belts and reducing downtime and maintenance costs.

BRIEF SUMMARY OF THE INVENTION

Described herein is a method and gas atmosphere to extend the life of a wire mesh belt by adding a certain controlled amount of endothermic gas into the nitrogen-hydrogen furnace atmosphere. In one aspect, there is provided a method for sintering metal components in a furnace at one or more operating temperatures comprising: providing the furnace comprising a belt comprising a wire mesh material wherein the metal components are supported thereupon; and sintering the components in the furnace in an atmosphere comprising nitrogen, hydrogen, and effective amount of endothermic gas at one or more operating temperatures ranging from about 1800° F. to about 2200° F. wherein the amount of endothermic gas in the atmosphere is such that it is oxidizing to the wire mesh material and reducing to the metal components. In this or other embodiments, the method wherein further comprises: pre-conditioning the furnace and belt to one or more pre-conditioning temperatures ranging from about 1400° F. to about 1700° F.; maintaining the belt at a stress-relief temperature ranging from about 1700° F. to about 1750° F. for at least one belt cycle in the atmosphere comprising nitrogen, hydrogen, and endothermic gas; heating the furnace and belt to one or more operating temperatures ranging from about 1800° F. to about 2200° F. in an atmosphere comprising nitrogen, hydrogen, and endothermic gas; and providing the metal component on the belt wherein the pre-conditioning, maintaining, and heating steps are conducted in the absence of the metal component and wherein the pre-conditioning, maintaining, and heating steps are conducted prior to the sintering step.

In another aspect, there is provided a method for treating a belt used to support one or more metal components in a continuous furnace during sintering wherein the method is conducted in absence of one or more metal components comprising the steps of: pre-conditioning the furnace and belt to one or more pre-conditioning temperatures ranging from about 1400° F. to about 1700° F.; maintaining the belt at a stress-relief temperature ranging from about 1700° F. to about 1750° F. for at least one belt cycle in the atmosphere comprising nitrogen, hydrogen, and endothermic gas; and heating the furnace and belt to one or more operating temperatures ranging from about 1800° F. to about 2200° F. in an atmosphere comprising nitrogen, hydrogen, and endothermic gas. In this or other embodiments, the method further comprises: providing one or more metal components on the belt; and sintering the components in the furnace in an atmosphere comprising nitrogen, hydrogen, and effective amount of endothermic gas at one or more operating temperatures ranging from about 1800° F. to about 2200° F. wherein the amount of endothermic gas in the atmosphere such that it is oxidizing to the wire mesh material and reducing to the metal components.

In a further aspect, there is provided a method for sintering metal components in a furnace at one or more operating temperatures comprising: providing the furnace comprising the belt comprising a wire mesh material and one or more metal components; pre-heating the furnace and belt to one or more pre-heating temperatures ranging from about 1000° F. to about 1600° F.; and sintering the components in the furnace in an atmosphere comprising nitrogen, hydrogen, and effective amount of endothermic gas at one or more operating temperatures ranging from about 1800° F. to about 2200° F. wherein the amount of endothermic gas in the atmosphere is such that it is oxidizing to the wire mesh material and reducing to the metal components.

DETAILED DESCRIPTION OF THE INVENTION

Figure 1:
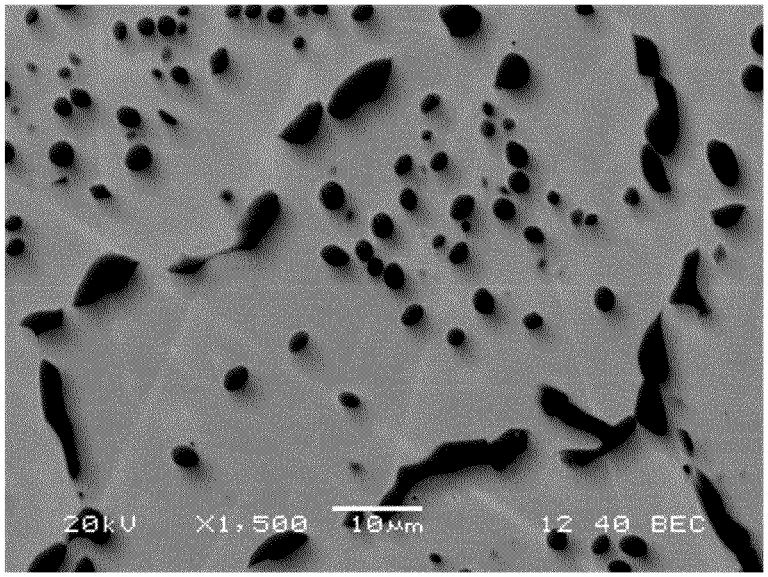
FIG. 1 is a secondary electron image, produced using Scanning Electron Microscopy (SEM), which shows chromium-rich precipitates in the microstructure of the stainless steel wire mesh belt after service in a sintering furnace using a furnace atmosphere that was 6% hydrogen and the balance nitrogen such as an atmosphere typically used in the prior art.

Powder metallurgy (PM) is routinely used to produce a variety of simple and complex-geometry steel components requiring close dimensional tolerances, good strength, and/or wear resistant properties. The technique involves pressing metal powders that have been premixed with organic binders and/or lubricants into useful shapes and then sintering them at high temperatures in continuous furnaces into finished products in the presence of controlled atmospheres. The overall cost of producing parts by powder metallurgy has been known to be greatly affected by both the time and money spent on maintaining the furnace and cost of controlled atmosphere. The productivity and quality of parts, on the other hand, are affected by furnace downtime and consistent composition of the controlled atmospheres, respectively. For example, the stainless steel belt within the furnace experiences service-related degradation, which includes wire deformation, wear, interaction with material from parts being processed, embrittlement and sensitization of the wire material, and/or surface deterioration that is related to cyclic oxidation and reduction of the belt surface. While not being bound by theory, it is believed that service-related degradation can be reduced by forming a protective oxide layer on the belt surface, which will extend the belt life. Therefore, there is a need to develop methods and/or atmospheres that will assist in reducing downtime and maintenance costs and improving quality and productivity of parts produced by powder metallurgy. The method and atmosphere described herein fulfills at least one of the needs in the art by adding an effective amount of endothermic gas (endo-gas) to the nitrogen-hydrogen atmosphere in order to modify the atmosphere dew point. In this way, it is believed that the resulting atmosphere, after the addition of the effective amount of endo-gas, will be oxidizing to the belt material yet reducing to the metal components contained therein thereby enabling an extended belt life.

Continuous furnaces used for sintering steel components are generally operated at high temperatures (above about 1,000° C. or about 1832° F.). Because of this high temperature operation, expensive, high temperature alloys such as Inconel 601®, Inconel 625®, RA3300, RA6000, RA 601®, RA 353MA®, and HR120® can be used for building heating zones of continuous furnaces. The use of these expensive, high temperature alloys helps in prolonging life of continuous furnaces and concomitantly reducing the maintenance cost. Alternatively, some end users may use relatively inexpensive stainless steels to build sintering furnaces in order to reduce costs. However, it is anticipated that the use of the relatively inexpensive stainless steels may increase the maintenance costs associated with operating the furnace.

The wire mesh belt materials, used to support steel components and move them through the zones of continuous furnaces, are generally made of either expensive, high temperature nickel-chromium containing alloys such as Inconel 600®, Inconel 601®, Inconel 625®, and the like. In other embodiments, relatively inexpensive stainless steels such as SS-304, SS-310, SS-314, or SS-316 can also be used as the belt materials. The wire mesh belt materials may differ in a variety of factors such as surface area, weave type, mesh diameter, cross-sectional weight, wire gauge, and/or wire diameter.

It is believed that the wire mesh belt material undergoes cyclic oxidation and reduction while sintering steel components in nitrogen-hydrogen atmospheres. Specifically, the belt material oxidizes in the preheating zone or in the ambient atmosphere and reduces in the high heating zone of the furnace by the nitrogen-hydrogen atmospheres. This cyclic oxidation and reduction of the belt material results in loss of belt material and increased stress due to continuous erosion and corrosion and reduced cross sectional area of the wire, respectively. Additionally, the belt material in the reduced form in the heating zone of the furnace is subjected to nitriding and carburizing conditions, causing embrittlement of the belt material due to the formation of metal carbides, nitrides and/or carbonitrides. The erosion and corrosion of belt material coupled with embrittlement by the formation of metal carbides, nitrides, and/or carbonitrides result in rapid degradation of the belt material and eventually failure of the belt.

It is also believed that the life of the belt is greatly reduced by the reaction between belt material and foreign materials splashed or flowed onto the belt in the high heating zone of the furnace. This reaction promotes the formation of low-melting point alloys, resulting in premature failure of the belt. The alloying of the belt material with foreign material is accelerated in the high heating zone of the furnace where the belt material is in the reduced form. In certain instances, copper may be used as an alloy in the PM part to improve the mechanical properties of iron carbon components by infiltrating the microstructure of the PM part during the sintering process. However, the life of stainless steel belt can be greatly reduced by forming low-melting point alloys if a portion of the copper within the PM part that the belt supports is splashed onto the stainless steel belt material during the sintering process.

It is also believed that the life of the belt is greatly reduced by erosion and corrosion caused by sticking of sintered components on the belt material, resulting in premature failure of the belt. The sticking of sintered components on the belt material is accelerated in the high heating zone of the furnace where the belt material is in the reduced form.

The premature failure of wire mesh belt due either to cyclic oxidation and reduction, formation of metal nitrides, carbides and/or carbonitrides, formation of low-melting point alloys, or sticking of sintered components on the belt material results in downtime and loss in production. Therefore, there is a need to develop improved nitrogen-hydrogen atmospheres for producing steel components by the powder metallurgy with consistent quality and properties while improving life of wire mesh belts and reducing maintenance costs.

The adherent oxide layer formed on the belt surface limits the amount of nitrogen and carbon absorbed by the belt material and therefore results in a decreased precipitation of metal carbides, nitrides, and/or carbonitrides. FIG. 1 provides an SEM image of the precipitation of chromium-rich carbides, nitrides and/or carbonitrides. These chromium-rich precipitates can cause embrittlement and sensitization of stainless steel and may negatively affect the service life of the belt.

The method described herein involves adding a controlled or effective amount of the endo-gas to the nitrogen-hydrogen atmosphere to increase the furnace atmosphere's dew point and assure the formation of an adherent protective oxide layer on the belt surface. Another benefit of the adherent oxide layer on the belt surface may be an improvement of the wear resistance of the belt and a reduction of the interaction of the belt material with metals from PM parts being processed. As previously mentioned, endo-gas, which is inexpensive and already available in many powder metal sintering facilities, typically contains about 40% nitrogen, about 40% hydrogen, about 20% carbon monoxide, and low levels of methane, carbon dioxide, oxygen, and moisture. In certain embodiments, the endothermic atmospheres may be produced by catalytically combusting controlled amount of a hydrocarbon gas, such as natural gas in air in endothermic generators.

It has been found that the life of wire mesh belts can be increased significantly by adding a controlled amount of endo-gas to the nitrogen-hydrogen atmospheres used for sintering steel components. The use of a controlled amount of an endo-gas has been found to accomplish at least one of the following: form a protective and adherent oxide layer on the belt material, eliminate complete reduction of the belt material in the heating zone of the furnace, and/or prevent sticking of sintered components on the belt material. It is believed that the foregoing are responsible for significantly increasing the belt life by reducing (1) erosion of the belt material caused by cyclic oxidation in the preheating zone of the furnace or in the ambient atmosphere outside the furnace and reduction in the high heating zone of the furnace, (2) embrittlement of belt material caused by the formation of metal carbides, nitrides and/or carbonitrides, and (3) the degradation of belt material by splashing of foreign material from parts being processed onto the belt. The amount of an endo-gas added along with nitrogen-hydrogen atmospheres to sinter steel components is controlled in such a way that the atmospheres become oxidizing to the belt material but reducing to the steel components being sintered, specifically in the high heating and cooling zones of continuous furnaces.

It has also been found that the life of the belt can be further improved by pre-conditioning new belts in atmospheres comprising nitrogen, optionally hydrogen, and a controlled amount of endo-gas. Once again, the use of controlled amount of endo-gas agent has been found to form a protective and adherent oxide layer on the belt material and reduce formation of nitrides while pre-conditioning new belt in nitrogen-based atmospheres.

In certain embodiments, the metal part to be sintered may be subjected to a pre-heating zone or step. The pre-heating step is generally conducted to remove any residual binder or lubricant within the metal component or part. In these embodiments, the pre-heating step is conducted at a range from about 1000° F. to about 1600° F. (about 540° C. to about 870° C.) which include, but are not limited to, any one of the following temperatures: 1000, 1025, 1050, 1075, 1100, 1125, 1150, 1175, 1200, 1225, 1250, 1275, 1300, 1325, 1350, 1375, 1400, 1425, 1450, 1475, 1500, 1525, 1550, 1575, or 1600° F. With regard to the foregoing, it is understood that any one of the pre-heating temperatures can serve as an endpoint to a range, such as, for example, about 1000 to 1325° F. or about 1125 to about 1600° F. Depending upon the part material, belt speed, heating zone length, and/or other variables, a metal part may be exposed to the one or more pre-heat temperatures in the pre-heating zone for a time ranging from about 20 to about 40 minutes.

As previously mentioned, the one or more metal components are sintered in an atmosphere comprising an effective amount of endothermic (endo-gas) to nitrogen-hydrogen. The effective amount of the endo-gas added to the nitrogen-hydrogen atmosphere is such that the atmosphere becomes oxidizing to the belt surface but reducing to the steel parts being sintered. The amount of endo-gas required to provide an oxidizing atmosphere to the stainless steel belt during sintering process depends on the high heating zone or sintering temperature of the furnace and the amount of hydrogen in the furnace atmosphere. Typical operating temperatures for the high heating or sintering zone of a continuous furnace range from about 1800° F. to about 2200° F. (about 1000° C. to about 1200° C.) which include, but are not limited to, any one of the following operating temperatures: 1800, 1825, 1850, 1875, 1900, 1925, 1950, 1975, 2000, 2025, 2050, 2075, 2100, 2125, 2150, or 2200° F. With regard to the foregoing, it is understood that any one of the operating temperatures can serve as an endpoint to a range, such as, for example, about 1850 to 2175° F. or about 2025 to about 2200° F. Depending upon the part material, belt speed, high heating zone length, and/or other variables, a metal part may be exposed to the one or more operating temperatures in the high heating zone for a time ranging from about 20 to about 40 minutes. During pre-conditioning of a new belt, the temperature in the furnace may be increased to the sintering and/or other temperatures (e.g., pre-heating and/or stress relief temperatures) in a variety of different methods such as a gradual ramp, a stepped ramp with or without intermittent periods at a certain temperature, and combinations thereof. In one particular embodiment, the temperature in the furnace is increased from the pre-heating, pre-conditioning, and/or maintaining temperatures to one or more sintering or operating temperatures at a temperature ramp rate of about 100° F. to about 300° F. per belt cycle.

In one particular embodiment, an effective amount of endo-gas is that amount added to the nitrogen-5% hydrogen atmosphere to increase the dew point of the furnace atmosphere in the high heating zone or sintering zone to about −40 to about −35° F. (−40 to −37° C.) for continuous furnaces equipped with a stainless steel belt and used to sinter steel components at temperature of about 2050° F. (about 1121° C.). In this or other embodiments, the effective amount of endo-gas is determined by measuring the baseline dew point of the nitrogen-hydrogen atmosphere and then adding endo-gas until the desired dew point is achieved. In certain embodiments, the amount of endo-gas added may range from about 1 to about 6% by volume of overall atmosphere. The dew point of the furnace atmosphere can be measured using a dew point analyzer and taken at the entrance of the furnace, the hot zone, the cooling zone, or combinations thereof. The actual atmosphere composition is achieved by adjusting gas flow rates and measured using gas analyzers. The amount of endo-gas in the atmosphere can be increased or decreased by adjusting its flow rate. The dew point of the furnace atmosphere can also be measured by performing an atmosphere profile of the furnace. In one particular embodiment, a ¼" tube is tied to the belt and sent through the furnace. In this embodiment, a sample is continuously extracted from the furnace as it passes through the furnace. This atmosphere sample flows through the dew point analyzer. The result is a plot of the dew point vs. location along the length of the furnace.

In one embodiment, the method described herein may be used in a continuous furnace equipped with an integrated heating and cooling zones for sintering steel components. The continuous furnace may be equipped with curtains in the discharge vestibule and a physical door in the feed vestibule to prevent air infiltration. The nitrogen-hydrogen atmosphere with an addition of endo-gas is introduced into the furnace through an inlet port or multiple inlet ports in the transition zone, which is located between the heating and cooling zones of the furnace. It can be introduced through a port located in the heating zone or the cooling zone, or through multiple ports located in the heating and cooling zones.

In certain embodiments, the effective amount of endo-gas is added to a furnace atmosphere comprising nitrogen and hydrogen atmosphere. In one embodiment, the atmosphere comprises from about 0.1% to about 25% by volume hydrogen and from about 75% to about 99% by volume nitrogen. Preferably, it contains hydrogen varying from about 1% to about 10%. In one embodiment, the hydrogen gas used in nitrogen-hydrogen atmosphere can be supplied in gaseous form in compressed gas cylinders or vaporizing liquefied hydrogen. In an alternative embodiment, it can be supplied by producing it on-site using an ammonia dissociator. The nitrogen gas used in nitrogen-hydrogen atmosphere preferably contains less than 10 parts per million (ppm) residual oxygen content. It can be supplied by producing it using well known cryogenic distillation technique. It can alternatively be supplied by purifying non-cryogenical generated nitrogen. The endo-gas added to the nitrogen-hydrogen atmosphere can be produced in endo generators.

The amount of an endo-gas added to the nitrogen-hydrogen atmosphere will depend on the composition of the endo-gas, material selected to fabricate wire mesh belt, concentration of hydrogen used in the nitrogen-hydrogen atmosphere, and/or temperature used to sinter steel components. It is added in such a way that the nitrogen-hydrogen atmosphere becomes oxidizing to the belt material throughout the furnace, but remains reducing to steel components sintered in the furnace.

Figure 2:
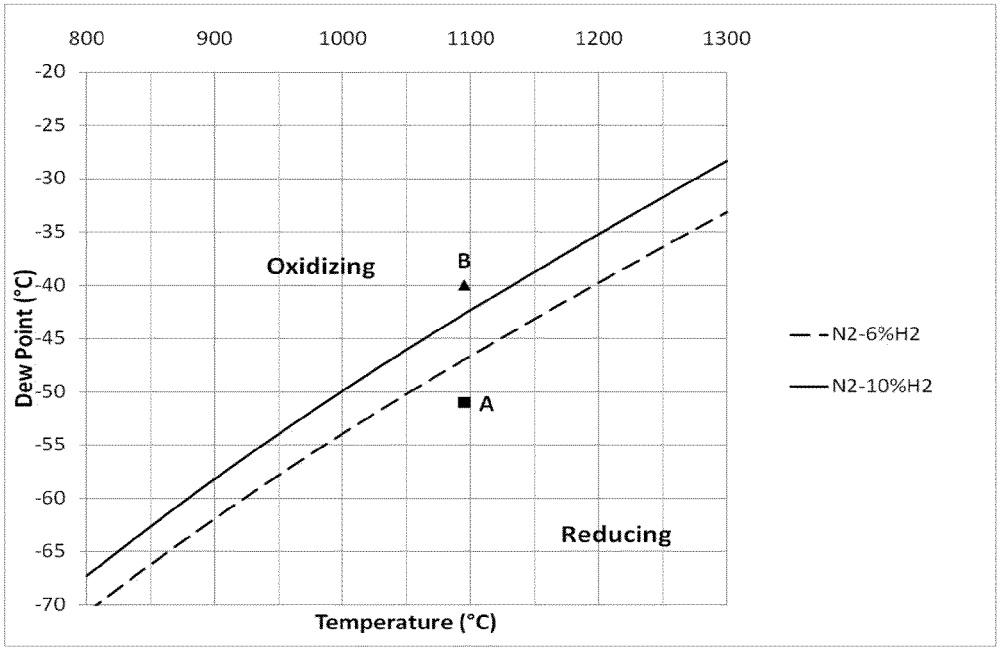
FIG. 2 shows an oxidation-reduction diagram or the relationship between temperature and dew point for a typical stainless steel. The diagram was calculated using the FactSage™ computer software program. The FactSage™ computer software program is a thermochemical software and database package developed jointly between Thermfact/CRCT (Montreal, Canada) and GTT-Technologies (Aachen, Germany)).

An effective amount of endo-gas is added to the nitrogen-hydrogen atmosphere is such that the atmosphere becomes oxidizing to the belt but reducing to the steel parts being sintered. In this regard, an amount of endo-gas is added to the furnace atmosphere to increase the dew point of the nitrogen-hydrogen atmosphere, which means to increase the moisture (water vapor) content of the furnace atmosphere. In one particular embodiment, the amount of moisture required to provide oxidizing atmosphere in the high heating zone of a sintering furnace operated at about 2,003° F. (1,095° C.) and equipped with a stainless steel belt will depend on the concentration of hydrogen in the nitrogen-hydrogen atmosphere. Referring to FIG. 2, if the nitrogen-hydrogen atmosphere contains 10% hydrogen by volume, a moisture level corresponding to the dew point of approximately −40° F. (−40° C.) (point B in FIG. 2) or higher will be needed to maintain oxidizing atmosphere for stainless steel belt material in the high heating or sintering zone of the furnace. The nitrogen-hydrogen atmosphere containing −40° F. (−40° C.) moisture or slightly higher will still be reducing to steel components being sintered in the high heating zone of the furnace. The use of a moisture level close to about −60° F. (−51° C.) (point A in FIG. 2) will be insufficient, and will result in reducing the stainless steel belt in the high heating or sintering zone and increased formation of chromium-rich nitrides, carbides and/or carbonitrides. It is important to note that the amount of moisture required to provide an oxidizing environment to the belt material in the high heating zone of the furnace needs to be adjusted up or down depending on the concentration of hydrogen used for sintering. For example, the amount of moisture needs to be increased (or decreased) with increased (or decreased) concentration of hydrogen in the nitrogen-hydrogen atmosphere. Furthermore, the amount of moisture required to provide oxidizing environment to the belt material in the high heating or sintering zone of the furnace needs to be adjusted up or down depending upon the operating temperature used. Similar adjustments can be used to establish the amount of moisture needed to maintain oxidizing atmosphere in the high heating zones of continuous furnaces equipped with belts made of materials other than stainless steel.

The amount of endo-gas added to the nitrogen-hydrogen atmosphere can vary depending upon the composition of the endo-gas, type of belt material, concentration of hydrogen, and/or sintering temperature selected for the operation. FactSage™ software calculations of the furnace atmosphere revealed that at the sintering or operating temperature of approximately 2050° F. (1121° C.), the amount of endo-gas, composed of 39.9% nitrogen, 39.9% hydrogen, 0.05% water vapor, 19.5% carbon monoxide, 0.45% carbon dioxide and 0.1% methane, added to the nitrogen-hydrogen atmosphere containing approximately 6% hydrogen and having dew point of −60° F. (−51° C.) may be from about 2.5 to about 4% by volume, which would increase the dew point of the nitrogen-6% hydrogen atmosphere to approximately −40° F. (−40° C.) to −35° F. (−37° C.), which corresponds to 127 ppm to 172 ppm moisture. If stainless steel belts are used for sintering steel components above about 1,832° F. (about 1,000° C.), the amount of endo-gas added to the nitrogen-hydrogen atmosphere containing about 5% hydrogen can result in dew points ranging up to about −15° F. (about −26° C.) (or about 566 ppm moisture). Preferably, it can be added in a proportion to bring the dew point of the nitrogen-hydrogen atmosphere to about −25° F. (about −32° C.) (or about 323 ppm moisture). More preferably, it can be added in a proportion to bring the dew point of the nitrogen-hydrogen atmosphere to about −35° F. (about −37° C.) (or about 172 ppm moisture). The amount of endo-gas added to the nitrogen-hydrogen atmosphere can vary depending upon the type of belt material, concentration of hydrogen, and/or operating temperature selected for the sintering step. In addition, the composition of the endo-gas can also be a factor. FactSage™ software calculations revealed that adding approximately 3% of endo-gas, composed of 39.9% nitrogen, 39.9% hydrogen, 0.05% water vapor, 19.5% carbon monoxide, 0.45% carbon dioxide and 0.1% methane to nitrogen-6% hydrogen atmosphere having dew point of about −60° F. (about −51° C.) at about 2050° F. sintering temperature may result in 0.6% carbon monoxide. However, this amount of carbon monoxide is negligible and is typically burned off as it exits the flame curtain of the furnace.

Steel powders that can be used to produce parts by sintering according to the present invention can be selected from Fe, Fe—C with up to 1% carbon, Fe—Cu—C with up to 20% copper and 1% carbon, Fe—Mo—Mn—Cu—Ni—C with up to 1% Mo, Mn, and carbon each and up to 4% Ni and Cu each, Fe—Cr—Mo—Co—Mn—V—W—C with varying concentrations of alloying elements depending upon the final properties of the sintered product desired. Other elements such as B, Al, Si, P, S, etc. can optionally be added to steel powders to obtain the desired properties in the final sintered product. These powders can be mixed with up to 2% zinc stearate or any other lubricant to assist in pressing components from them.

In one embodiment, the method and atmosphere described herein can be used to pre-condition the wire mesh belt prior to its operation in the furnace. In this embodiment, it is anticipated that the pre-conditioning step is conducted once during the belt's operational life and in the absence of one or more metal components. The pre-condition step may be used to treat the surface of the belt within the furnace under heat and make it less receptive to nitrogen. The pre-condition step is typically conducted by heating the wire mesh belt gradually to its operating temperature without product for at least one to three full cycles (e.g., exposure of each portion of its length to the operating temperature). Depending upon the length of the furnace and the belt speed, a cycle may run from 1 to 3 hours. According to the standard pre-conditioning procedures, the belt is heated without product to one or more pre-conditioning temperatures which include, but are not limited to, any one of the following temperatures: 1400, 1425, 1450, 1475, 1500, 1525, 1550, 1575, 1600, 1625, 1650, 1675, 1700, 1725, or 1750° F. With regard to the foregoing, it is understood that any one of the pre-conditioning temperatures can serve as an endpoint to a range, such as, for example, 1400 to 1475° F. or 1400 to 1700° F. The temperature in the furnace may be increased to the pre-conditioning, stress-relief, and/or heating temperatures in a variety of different methods such as a gradual ramp, a stepped ramp with or without intermittent periods at a certain temperature, and combinations thereof. In embodiments wherein the temperature of the furnace is increased step-wise, the temperature may be increased at a rate ranging from about 100° F. to about 300° F. per cycle (e.g., time it takes belt material to complete entire cycle through furnace). In one embodiment, the pre-heating step may be conducted in an atmosphere comprising air. In another embodiment, the pre-heating step is conducted in an atmosphere comprising nitrogen. After the furnace and belt has been maintained at the one or more stress relief temperatures for at least one belt cycle in an atmosphere comprising nitrogen, hydrogen, and endo-gas, the furnace and belt is then heated to one or more operating temperatures ranging from about 1800° F. to about 2200° F. in an atmosphere comprising nitrogen, hydrogen, and endothermic gas for at least two belt cycles prior to the introduction of product in the furnace.

In one particular embodiment of the pre-conditioning method described herein, after the furnace has reached a stress relief temperature range of about 1700° to about 1750° F. (about 927 to about 954° C.), an effective amount of endo-gas is added to an atmosphere comprising nitrogen and hydrogen atmosphere. In this or other embodiments, the temperature in the furnace is increased to one or more pre-conditioning temperatures from the pre-heating and/or starting temperature at a temperature ramp rate of about 100° F. to about 300° F. per belt cycle. An effective amount of endo-gas is added to the nitrogen or nitrogen and hydrogen containing atmosphere and the belt is allowed to cycle in the stress relief temperature range for at least one full belt rotation. The amount of endo-gas added to the furnace atmosphere is controlled in such a way that the atmosphere comprising nitrogen, hydrogen, and endothermic gas is oxidizing to the belt material during the pre-conditioning. In this regard, the pre-conditioning method described herein may avoid at least one of the following: (1) exposing the belt material to a mixture of nitrogen and hydrogen and (2) prematurely nitriding the belt material.

In one particular embodiment, a new mesh belt is pre-conditioned without product in the furnace by standard stepwise heating at a rate of about 300° F. per normal conveyor cycle of the belt to a temperature of about 1700° F. (about 927° C.) under flowing nitrogen (nitrogen flow reduced by over two times); afterwards, the belt is maintained at the pre-condition temperature of about 1700° F. (about 927° C.) for at least two complete belt rotations in an atmosphere comprising nitrogen, hydrogen and an effective amount of endo-gas for stress relief; and then the belt is heated stepwise at a rate of about 300° F. to its high heating zone or sintering temperature over a period of time between 7 and 30 hours in an atmosphere comprising nitrogen, hydrogen and the endothermic gas; and lastly operated unloaded for at least 3 cycles and/or up to 100 hours to increase the creep strength of the belt.

Although the method has been described in terms of increasing life of wire mesh belts used in sintering steel components, it is also anticipated that it will improve the life of various furnace fixtures such as, but not limited to, the muffle, retorts, and fixtures used to process PM parts. Furthermore, it can also be applicable for increasing life of wire mesh belts used in high temperature brazing using low dew point brazing pastes or preforms.

The following examples illustrate the method and gas atmosphere described herein for sintering metal components and are not intended to limit it in any way.

EXAMPLES

Comparative Example 1

Pre-Conditioning of Belt and Sintering Parts at Operating Temperatures Using Nitrogen-6% Hydrogen Atmosphere A type 314 stainless steel wire mesh belt BEF-36-10-8-10 (balanced extra flat weave with 36 spiral loops per foot of width and 10 cross rods per foot of length; 8 gauge rod; 10 gauge spiral) with welded edges, 12 inches wide, in as-manufactured condition, was installed in an industrial continuous sintering furnace. The belt was provided by Bristol Metal Products. The furnace was used for sintering different ferrous PM parts, including F-0000, F-0005, F-0008, FC-0205, FC-0208, and FN-0205, in a nitrogen-6% hydrogen atmosphere at about 2050° F. (about 1121° C.), at the belt speed of about 3.9 inches per minute.

The belt was pre-conditioned using the conventional procedure, prior to using it for sintering parts at typical sintering temperatures. During the pre-conditioning process, the belt was heated in 100° F. increments per belt revolution under flowing nitrogen (nitrogen flow was reduced by over 2 times as compared to the normal operating conditions). Each temperature was maintained for a period of 2 hours. At about 1700° F. (about 927° C.), the furnace atmosphere was changed to a nitrogen-6% hydrogen atmosphere. Stepwise heating was continued until the normal operating or sintering temperature was reached of about 2050° F. (about 1121° C.) under normal operating atmosphere nitrogen-6% hydrogen.

A long-term sintering experiment to test the belt was carried out in the presence of a nitrogen-hydrogen atmosphere containing 6% hydrogen. This atmosphere was introduced through an inlet port in the transition zone that was located between the high heating and cooling zones of the furnace. Samples of the furnace atmosphere taken at different time intervals revealed that it contained less than 3 ppm oxygen and the dew point of the atmosphere in the high heating zone was −60° F. (−51° C.) (ppm moisture).

Analysis of the furnace atmosphere revealed that the atmosphere was oxidizing to the stainless steel belt in the preheating zone, but reducing in the high heating zone. The belt material was, therefore, subjected to a continuous and cyclic oxidation and reduction process, causing it to erode and making it prone to nitrogen pick-up. The belt material was nitrided from the nitrogen present in the furnace atmosphere and carburized from the hydrocarbons released into the furnace atmosphere by the removal of lubricants from the components. The nitriding and carburizing of the belt material was accelerated in the high heating zone where the furnace atmosphere was reducing to the belt material and where the belt material was in the reduced form. The accelerated nitrogen pick-up started during the pre-conditioning procedure when the belt in the reduced form was exposed to the nitrogen-6% hydrogen atmosphere.

Microstructure analysis of the belt material using Scanning Electron Microscopy combined with Energy Dispersive X-ray Analysis (SEM/EDX) and nitrogen analysis using Inert Gas Fusion/Thermal-conductivity method were conducted on the belt samples that were obtained when the stretched belt was shortened. The belt was shortened when its length exceeded the acceptable limit for operation in the furnace. At this time, a section of the belt, which was comprised of both the spiral weave wire and the cross rod wire, was eliminated. The nitrogen concentration revealed by the first analysis of the spiral wire was 1.09% by weight. At this time, the SEM/EDX analysis of the belt microstructure revealed the formation of chromium-rich carbides, nitrides and/or carbonitrides.

After 35 weeks of service, SEM/EDX analysis of the microstructure, nitrogen analysis of the spiral wire material, and tensile test of the cross rod wire were conducted. The microstructure analysis revealed increased concentration of chromium-rich carbides, nitrides and/or carbonitrides. These precipitates reduced the ductility of the belt material and had a negative impact on the belt service life. The depth of intergranular oxidation that was revealed using SEM/EDX methods is presented in Table 1. The nitrogen concentration of the spiral wire material was 1.41% by weight. Various tests were run on the belt rod after 35 weeks of service and the results are provided in Table 2. Tensile tests were performed in accordance with ASTM A370 standard test methods and definitions for mechanical testing of steel products. The tensile tests were performed in a laboratory accredited by Performance Review Instituted (PRI) to ISO18025 and by Nadcap for Nondestructive Testing (NDT) and Materials Testing for the test methods and specific services. Microscopic analysis of the belt rod conducted by SEM microscopy shows deep intergranular oxidation which is undesirable.

TABLE 1

| Intergranular Oxidation Depth | |
|---|---|
| Rod Wire (μm) | Spiral Wire (μm) |
| ≤130 (typical)<br>180 (maximum) | ≤125 |

TABLE 2

| Tensile Test of Rod Wire | | | |
|---|---|---|---|
| TENSILE STRENGTH | YIELD (0.2%) STRENGTH | ELONGATION (IN 4D) | REDUCTION OF AREA |
| 74.9 ± 2.2 ksi<br>516.4 ± 15.3 MPa | 44.2 ± 7.3 ksi<br>305.0 ± 50.3 MPa | 13.8 ± 0.6% | 11.6 ± 1.4% |

Example 2

Pre-Conditioning of Belt and Sintering Parts at Operating Temperatures Using Nitrogen/6% Hydrogen/2% Endo-Gas Atmosphere The same type of 314 stainless steel belt was installed in the same furnace as in Comparative Example 1. The weave and diameters of the spirals and rods, as well as the belt edge, were the same, as compared to the belt in Comparative Example 1. The belt was provided by the same supplier. In this experiment, the furnace was used for sintering the same type ferrous components. The temperatures and belt speeds were maintained at the same levels as in Comparative Example 1.

The belt was pre-conditioned using a modified procedure prior to using it for the sintering processes. The modification of the conventional pre-conditioning procedure was the following: instead of using nitrogen-6% hydrogen atmosphere above 1700° F. (927° C.), nitrogen-hydrogen-endo blend was used. Approximately 2% (by volume) endo-gas was added to the nitrogen-6% hydrogen atmosphere prior to its introduction into the furnace through the inlet port located in the transition zone. The resulting atmosphere dew point was maintained in the range of −40 to −35° F. (40 to −37° C.), so this atmosphere was always mildly oxidizing to the belt material during the pre-conditioning process of the belt. The objective of this modification to the pre-conditioning procedure was to decrease or eliminate nitrogen pick-up by the belt material.

The long-term sintering experiment was carried out in the presence of a nitrogen-hydrogen atmosphere with the addition of endo-gas. Approximately 2% (by volume) endo-gas was mixed with the nitrogen and hydrogen prior to its introduction into the furnace. The nitrogen-hydrogen-endo mixture was introduced through an inlet port in the transition zone that was located between the high heating and cooling zones of the furnace. Atmosphere analysis in the high heating zone of the empty furnace revealed that the resulting atmosphere contained about 6.3% hydrogen and 0.3% carbon monoxide. No carbon dioxide or methane was revealed using an infrared tri-gas (CO, $CO_2$, and $CH_4$) analyzer.

The dew point of the furnace atmosphere was monitored by repeated analyses of the furnace atmosphere throughout the long term sintering experiment. The dew point was maintained at the level of about −35° F. (about −37° C.) by adding usually 1.6 to 3.5% endo-gas (by volume). The endo-gas flow rate was adjusted manually when the composition of the endo-gas changed. The standard quality control of the sintered parts did not reveal any problems related to the new atmosphere composition.

Microstructure analysis of the belt material using Scanning Electron Microscopy combined with Energy Dispersive X-ray Analysis (SEM/EDX) was conducted on the belt samples after 17 weeks of service in the sintering furnace. No nitrides or carbonitrides were revealed in the microstructure of the belt after 17 weeks of service.

After 35 weeks of service, SEM/EDX analysis of the microstructure, nitrogen analysis of the spiral wire material, and tensile test of the rod wire were conducted. The microstructure analysis revealed some chromium-rich carbides, nitrides and/or carbonitrides. The depth of intergranular oxidation that was revealed using SEM/EDX methods is presented in Table 3. Intergranual oxidation is not showing up as deeply into the rod wire and spiral wire compared to the rod wire and spiral wire analyzed in Comparative Example 1. The nitrogen concentration was 0.74% by weight. The results of a tensile test of the belt rod after 35 weeks of service are shown in Table 4. The tensile tests were conducted in the same manner as that for Comparative Example 1.

TABLE 3

| Intergranular Oxidation Depth | |
|---|---|
| Rod Wire (μm) | Spiral Wire (μm) |
| <25(typical)<br>110 (maximum) | ≤50 |

TABLE 4

| Tensile Test of Rod Wire | | | |
|---|---|---|---|
| TENSILE STRENGTH | YIELD (0.2%) STRENGTH | ELONGATION (IN 4D) | REDUCTION OF AREA |
| 82.7 ± 3.5 ksi<br>570.2 ± 23.9 MPa | 49.9 ± 2.4 ksi<br>344.3 ± 16.3 MPa | 16.8 ± 0.6% | 12.4 ± 1.1% |

Comparison of the samples of two belts after the same service time (35 weeks) in the same sintering furnace, operating at the same temperatures and belt speeds and used to sinter the same type ferrous components, revealed that the belt exposed to the atmosphere produced by mixing nitrogen-6% hydrogen with endo-gas exhibited a lower level of service-related deterioration. Based on 95% confidence intervals, the tensile strength and elongation of this belt were significantly higher than the corresponding tensile properties of the one operated without endo-gas. Nitrogen pick-up was about half of the corresponding value for the belt exposed to the regular nitrogen-6% hydrogen atmosphere. Comparing Tables 1 and 3, the depth of the intergranular oxidation of the wire exposed to the nitrogen-hydrogen-endo atmosphere was considerably lower, as compared to the wire exposed to the nitrogen-6% hydrogen atmosphere. The typical depth of the intergranular oxidation of the rod wire and the spiral wire were less than 25 μm and 50 μm, respectively, for nitrogen-hydrogen with a small addition of endo-gas; while the depth of the intergranular oxidation of the rod and the spiral wires exposed to the nitrogen-hydrogen atmosphere without endo were 130 μm and 125 μm, respectively. In addition, the SEM/EDX analysis of the spiral microstructures and rod microstructures revealed a lower concentration of precipitates in the central areas of the wires exposed to the atmosphere composed of nitrogen, hydrogen and endo-gas. The comparison of the same type belts after the same service time in the same furnace clearly proved that the service-related deterioration of the belt material, which directly affects the service life of the belt, can be significantly postponed by adding the specified amount of endo-gas to the nitrogen-hydrogen atmosphere.

We claim:

1. A method for sintering steel components in a furnace at a one or more operating temperatures, the method comprising:

providing the furnace comprising a belt comprising a wire mesh material wherein the steel components are supported thereupon;

pre-conditioning the furnace and belt to one or more pre-conditioning temperatures ranging from about 1400° F. to about 1700° F.;

maintaining the belt at a stress-relief temperature ranging from about 1700° F. to about 1750° F. for at least one belt cycle in an atmosphere comprising nitrogen, hydrogen, and endothermic gas;

heating the furnace and belt in absence of a metal component to the normal operating temperature ranging from about 1800° F. to about 2200° F. in an atmosphere comprising nitrogen, hydrogen, and endothermic gas;

providing one or more steel components on the belt; and sintering the components in the furnace in an atmosphere comprising nitrogen, hydrogen, and an effective amount of endothermic gas at the one or more operating temperatures ranging from about 1800° F. to about 2200° F. wherein the amount of endothermic gas in the atmosphere is such that it is oxidizing to the wire mesh material and reducing to the steel components and the dew point of the atmosphere is greater than or equal to −40° F., and wherein the pre-conditioning, maintaining, and heating steps are conducted in the absence of the steel components and wherein the pre-conditioning, maintaining, and heating steps are conducted prior to the sintering step, and wherein the temperature is increased from the pre-conditioning step to the maintaining step at a rate of about 100° F. to about 300° F. per belt cycle.

2. The method of claim 1, wherein the concentration of the endothermic gas in the sintering atmosphere ranges from about 0.1 to about 6 percent by volume.

3. The method of claim 1, wherein the temperature is increased from the maintaining step to the heating step at a rate of about 100° F. to about 300° F. per belt cycle.

* * * * *